US005725040A

United States Patent [19]

Domel

[11] Patent Number: 5,725,040

[45] Date of Patent: Mar. 10, 1998

[54] SUSPENSION CORD WINDING DEVICE FOR WINDOW COVERING

[75] Inventor: Douglas R. Domel, Chatsworth, Calif.

[73] Assignee: Harmonic Design, Inc., Chatsworth, Calif.

[21] Appl. No.: 666,249

[22] Filed: Jun. 20, 1996

[51] Int. Cl.[6] ..... E06B 9/30

[52] U.S. Cl. ..... 160/170 R; 160/178.1 R; 160/173 R

[58] Field of Search ..... 160/170 R, 171 R, 160/178.3 R, 178.1 R, 173 R, 168.1 R

[56] References Cited

U.S. PATENT DOCUMENTS

| | | | |
|---|---|---|---|
| 3,352,349 | 11/1967 | Hennequin | 160/171 R |
| 3,809,143 | 5/1974 | Ipekgil | 160/168 |
| 4,413,664 | 11/1983 | Istha | 160/178 C |
| 4,443,915 | 4/1984 | Niemeyer | 24/132 R |
| 4,518,025 | 5/1985 | Judkins | 160/84 R |
| 4,522,244 | 6/1985 | Brolin | 160/170 R |
| 4,557,309 | 12/1985 | Judkins | 160/84 R |
| 4,623,012 | 11/1986 | Rude et al. | 160/243 |
| 4,673,018 | 6/1987 | Judkins | 160/84 R |
| 4,974,656 | 12/1990 | Judkins | 160/84.1 |
| 5,184,660 | 2/1993 | Jelic | 160/170 R |
| 5,228,491 | 7/1993 | Rude et al. | 160/170 R |
| 5,328,113 | 7/1994 | de Chevron Villette et al. | 242/388 |

*Primary Examiner*—Blair Johnson
*Attorney, Agent, or Firm*—John L. Rogitz

[57] ABSTRACT

A suspension cord guide for a window blind includes an L-shaped guide member positioned within the head rail of the blind. The guide member is positioned adjacent an opening in the head rail through which the suspension cord extends. Also, the suspension cord guide includes a hollow spindle surroundingly engaged with a tilt rod in the head rail, and the spindle is formed with an abutment surface on its end nearest the opening. A finger of the L-shaped member extends toward the spindle, with the suspension cord being fed onto the spindle next to the abutment surface by the guide member. In addition to guiding the cord onto the spindle, the finger of the L-shaped guide member contacts the coil of the suspension cord that is established on the spindle nearest the finger. When the tilt rod (and, hence, spindle) is rotated, the cooperation of structure between the finger and the suspension cord coils that are established on the spindle causes successive coils to be pushed along the spindle and away from the opening in the head rail, thereby ensuring that the coils do not overlap each other.

7 Claims, 3 Drawing Sheets

SUSPENSION CORD WINDING DEVICE FOR WINDOW COVERING

FIELD OF THE INVENTION

The present invention relates generally to window coverings, and more particularly to devices for raising the slats of horizontal window blinds.

BACKGROUND

Window coverings such as horizontal blinds, horizontal pleated shades, and cellular shades include horizontally-oriented slats. Typically, the slats of a window covering are suspended from a head rail of the window covering by means of a plurality of cords. Certain of the cords, referred to herein as tilt cords, can be operated to, e.g., tilt the slats of a horizontal blind. Certain other of the cords, referred to herein as suspension cords, can be operated to raise the slats of a blind or pleated shade.

Ordinarily, the suspension cord of a window covering such as a horizontal blind extends into the head rail through an opening in the head rail. The suspension cord can be pulled axially to raise the slats, and it can also be released to permit the slats to lower under the influence of gravity.

Of importance to the present invention are window coverings which include a suspension cord that is pulled by a motor. In such systems, the suspension cord typically is connected to a so-called tilt rod that is rotatably mounted in the head rail, and the tilt rod can be rotated by a motor to wind the suspension cord onto the tilt rod and thereby raise the slats, without requiring a person to manually pull the suspension cord. U.S. Pat. No. 5,495,153, assigned to the same assignee to which the present invention is assigned and incorporated herein by reference, discloses one such system.

Not surprisingly, devices have been disclosed for smoothly guiding a suspension cord onto a tilt rod, such that successive coils of the cord do not overlap. This is to ensure smooth operation of the system during winding (i.e., raising the slats) and unwinding (i.e., lowering the slats).

An example of such a device is disclosed in Somfy's U.S. Pat. No. 5,328,113. As disclosed in the Somfy patent, a suspension cord is affixed to a winding drum having a shoulder formed on one end. The drum is telescoped onto the head rail, and the drum has a radially enlarged segment next to the shoulder and a radially smaller segment extending from the radially enlarged segment. The cord is guided onto the radially enlarged segment tangentially to the shoulder, and when the winding drum is rotated, the shoulder pushes successive coils of the cord off the radially enlarged segment and onto the radially smaller segment.

As recognized by the present invention, however, the Somfy device has several drawbacks. Specifically, because the Somfy device requires a radially enlarged segment for cooperating with the shoulder to move the suspension cord coils along the drum, the suspension cord must bend around the radially enlarged segment as it enters the head rail through the head rail opening. This causes undesirably high frictional losses as the cord rubs against the edge of the opening. Such relatively high friction losses are particularly deleterious in systems that use battery-powered motors to turn the head rail, because battery-powered systems, to be commercially feasible, must be characterized by relatively long battery life. Moreover, I have discovered that when devices that are made in accordance with the Somfy design are incorporated into large blinds which include heavy slats, coil overlap on the drum in fact can occur. Still further, the Somfy invention requires affixing the end of the suspension cord to the drum, thereby limiting the area onto which the cord end can be attached and thus making adjustment of the cord relatively difficult.

As further recognized by the present invention, however, it is possible to provide a suspension cord guide for a window covering which does not induce unwanted large frictional losses during winding of the suspension cord within a head rail, and which permits easy adjustment of the suspension cord end within the head rail. Accordingly, it is an object of the present invention to provide a device for guiding a suspension cord into a head rail of a window covering which does not induce large frictional losses. Another object of the present invention is to provide a device for guiding a suspension cord into a head rail of a window covering which can be used with large and small window coverings. Still another object of the present invention is to provide a device for guiding a suspension cord into a head rail of a window covering which is easy to use and cost-effective.

SUMMARY OF THE INVENTION

A device is disclosed for winding at least one suspension cord of a window covering having slats, a horizontally-oriented head rail, and a tilt rod disposed in the head rail. Per well-known principles, the head rail is formed with an opening through which the suspension cord extends. In accordance with the present invention, the device includes a hollow spindle that surroundingly engages the tilt rod and that is rotatable therewith. As disclosed in detail below, the spindle includes a winding surface which defines a first end, and the suspension cord establishes a plurality of coils on the winding surface at least when the slats are not in a fully lowered configuration. Additionally, the device includes a guide finger which is disposed in the head rail adjacent the opening and which extends toward the spindle, with the suspension cord extending through the opening between the finger and the first end. Per principles of the present invention, the finger is oriented such that the finger contacts at least one coil, thereby pushing coils of the suspension cord formed on the winding surface away from the finger such that successive coils are established on the winding surface of the spindle without overlapping.

In one preferred embodiment, the window covering includes a tilt cord that is engaged with the slats for tilting the slats, and the device includes a pulley formed with a tilt cord groove for receiving the tilt cord. Also, the pulley establishes a radial abutment on the first end of the spindle. Desirably, the tilt cord groove is characterized by a rectangular cross-section.

Preferably, the device includes a lower mount and an upper mount, and the mounts are engaged with each other and with the head rail. The finger is formed on the lower mount. Also, the spindle is disposed between the mounts, with the upper mount being formed with a curved channel closely spaced from the spindle.

Additionally, the tilt rod defines a transverse cross-section, and the device includes a hollow adapter having a central passageway configured for closely engaging the tilt rod. Moreover, the adapter defines an outer surface that is receivable within the spindle in an interference fit therewith to thereby couple the tilt rod to the spindle. Advantageously, a clip is formed with a rod groove configured for closely engaging the tilt rod and a cord groove juxtaposed with the rod groove and oriented parallel thereto for closely receiving the suspension cord. The clip consequently can hold the suspension cord stationary relative to the tilt rod.

In another aspect, a window covering is disclosed which incorporates the device discussed above.

In still another aspect, a device is disclosed for winding the suspension cord of a window covering when a tilt rod of the window covering is rotated. Per the present invention, the device includes a spindle engaged with the tilt rod, and an L-shaped guide member juxtaposed with the spindle. The L-shaped guide member guides the suspension cord onto the spindle and contacts a coil of the suspension cord to push the coils along the spindle such that successive coils are formed on the spindle without overlapping each other.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
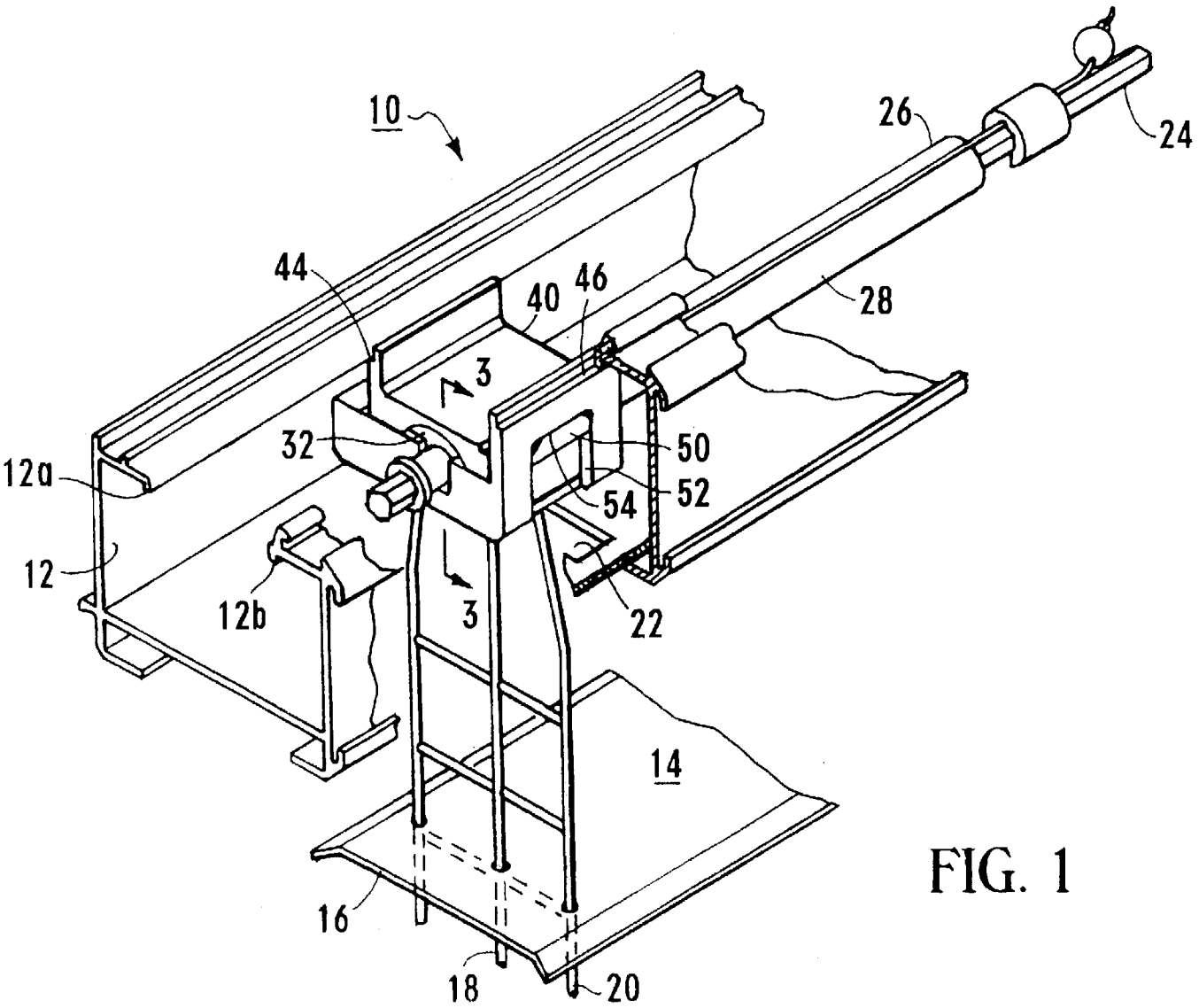
FIG. 1 is a perspective view of the suspension cord winding device shown in operable engagement with the head rail of a window blind.

Referring initially to FIG. 1, a suspension cord winding device, generally designated 10, is shown in operable engagement with a head rail 12 of a window blind 14. As shown, the window blind 14 is a horizontal-type venetian blind having a plurality of horizontally-oriented slats 16. In accordance with principles well-known in the art, the slats 16 are suspended from the head rail 12 by means of suspension cords 18 and tilt cords 20 (only one suspension cord 18 and one tilt cord 20 shown in FIG. 1). It is to be understood that while FIG. 1 shows the device 10 in operable engagement with a horizontal-type window blind 14, the device 10 can be used with other types of window coverings, e.g., cellular shades, pleated shades, and Roman shades.

As shown in FIG. 1, the cords 18, 20 extend into the head rail 12 through opposed elongated rectangular or ovular openings 22 that are formed in the head rail 12 (only one opening 22 shown for clarity of disclosure). It can be appreciated in reference to FIG. 1 that the cords 18, 20 are coupled, via the device 10, to a tilt rod 24 that is disposed in the head rail 12 more or less coaxially with the head rail 12. The tilt rod 24 shown in FIG. 1 is characterized by a hexagonal transverse cross-section as shown. In accordance with well-known window blind operating principles, the tilt rod 24 can be rotated to move the suspension cord 18 and thereby raise and lower the slats, or to move the tilt cord 20 and thereby tilt the slats about their respective axes. In one preferred embodiment, the tilt rod 24 is engaged with a motorized mechanism as disclosed in U.S. Pat. No. 5,495,153, incorporated herein by reference, to facilitate automatic and remote operation of the tilt rod 24.

Figure 2:
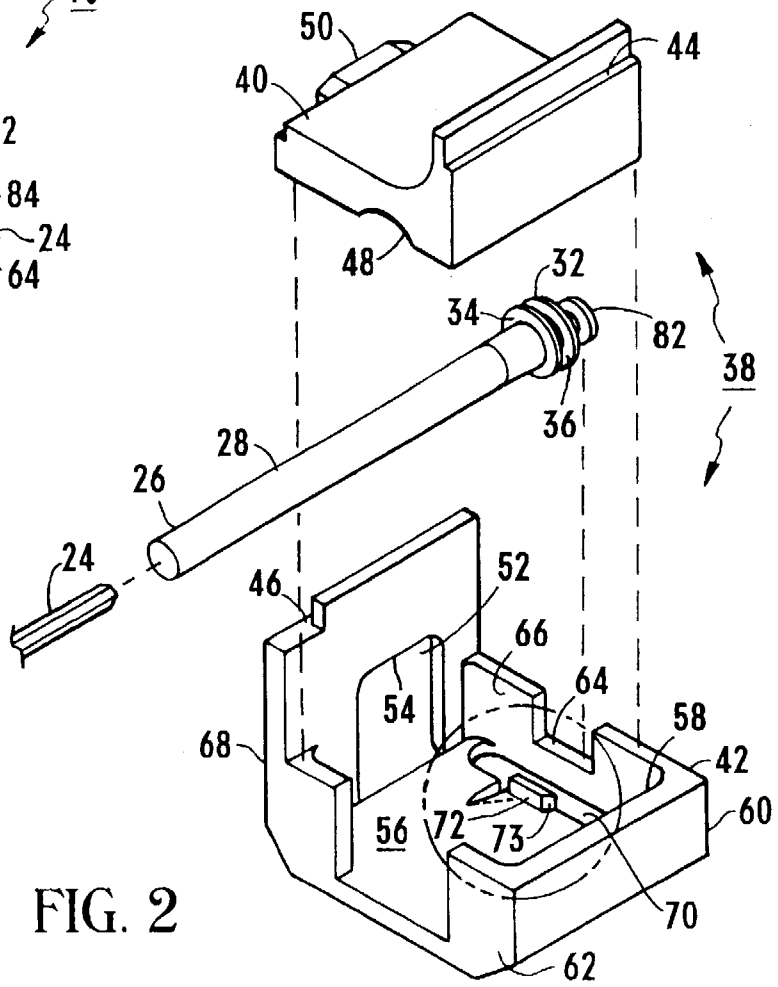
FIG. 2 is an exploded perspective view of the suspension cord winding device.
Figure 3A:
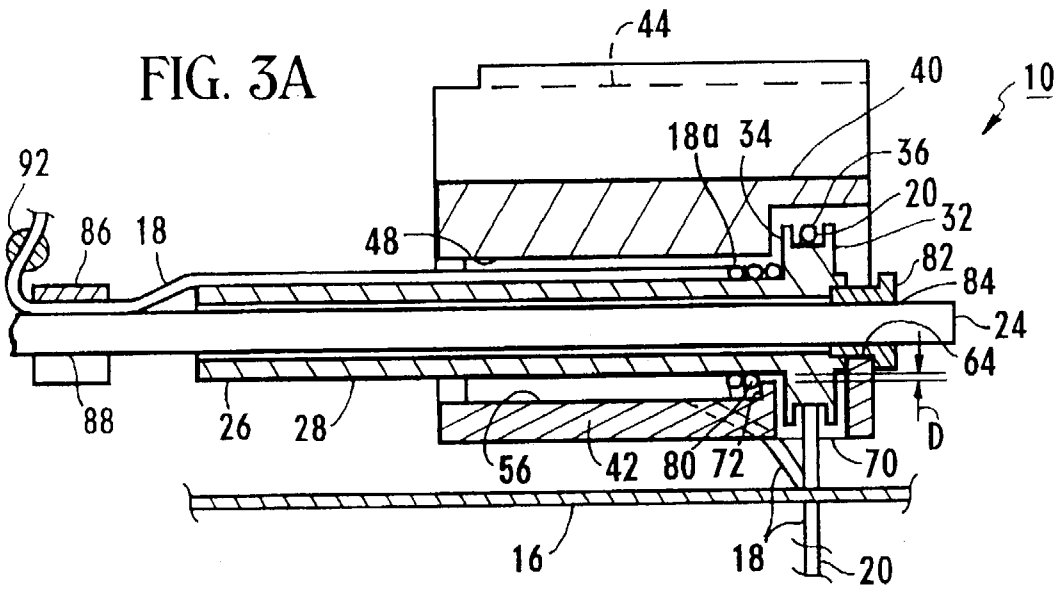
FIG. 3A is a cross-sectional view of an alternate embodiment, as would be seen along the line 3—3 in FIG. 1.
Figure 3:
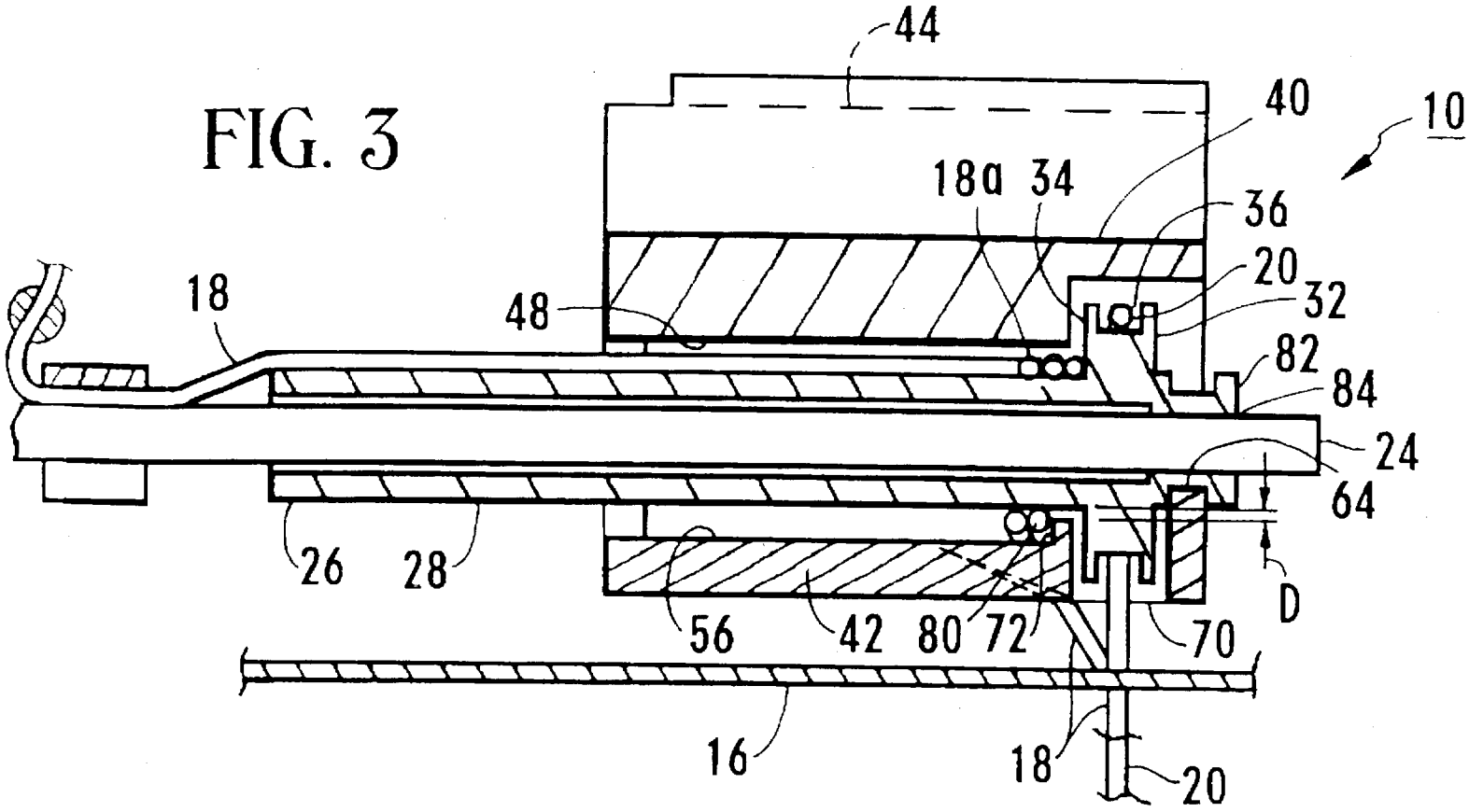
FIG. 3 is a cross-sectional view, as seen along the line 3—3 in FIG. 1.

The details of the suspension cord winding device 10 of the present invention can be appreciated in reference to FIGS. 2 and 3. It is to be understood that each opening 22 of the head rail 12 is associated with a respective winding device of the present invention. For clarity of disclosure, only the device 10 shown in the Figures will be described herein.

As shown, the device 10 includes a hollow tubular spindle 26. The spindle 26 surroundingly engages the tilt rod 24 and rotates with the tilt rod 24 as discussed further below. FIG. 2 best shows that the spindle 26 defines a generally cylindrical winding surface 28 that in turn defines a left end (looking down on FIG. 1), and a pulley 32 is formed integrally with the winding surface 28 on the left end. Per the present invention and as shown in FIG. 2, the pulley 32 establishes a radial abutment surface 34.

While the winding surface 28 is generally cylindrical, and indeed may be exactly cylindrical, it is to be understood that the winding surface 28 can be slightly tapered inwardly away from the pulley 32, to facilitate removing the spindle 26 from an injection mold. Alternatively, the spindle 26 can be made by extrusion principles well-known in the art, in which case the winding surface can be exactly cylindrical. Thus, the spindle 26 need be slightly tapered only for injection molding manufacturing purposes, not for functional purposes, for reasons to be shortly disclosed.

With particular regard to the pulley 32, FIGS. 2 and 3 show that the pulley 32 is circumscribed by a tilt cord groove 36 that is characterized by a rectangular cross-section. As shown, the tilt cord 20 is received in the tilt cord groove 36 of the pulley 32. I have discovered that the rectangular cross-section of the tilt cord groove 36 affords improved tilting capability vis-a-vis pulley grooves having other shapes, e.g., V-shaped grooves. As the skilled artisan will appreciate, when the spindle 26 is rotated, the pulley 32 rotates to move the tilt cord 20 translationally in the vertical dimension.

In cross-reference to FIGS. 1 and 2, a guide, generally designated 38, is snappingly engaged with the head rail 12 in a surrounding relationship with the spindle 26. In the presently preferred embodiment, the guide 38 includes an upper mount 40 and a lower mount 42. As shown, the upper mount 40 is formed with an L-shaped flange 44 that is complementarily configured with a rear flange **12*a* of the head rail 12 for flushly abutting the rear flange 12*a*. Likewise, the lower mount 42 is formed with an L-shaped flange 46 that is complementarily configured with a front flange 12*b* of the head rail 12 for flushly abutting the front flange 12*b*. Per the present invention, the mounts 40, 42 are dimensioned such that when the mounts 40, 42 are connected together as described below to establish the guide 38, the L-shaped flanges 44, 46 cooperate with the flanges 12*a*, 12*b* of the head rail 12 to facilitate an interference fit between the guide 38 and the head rail 12**.

It can be appreciated in reference to FIG. 2 that the spindle 26 is positioned between the mounts 40, 42. Accordingly, the upper mount 40 is formed with a curved spindle channel 48 that is configured complentarily to the spindle 26, with the wall of the spindle channel 48 being closely spaced from the spindle 26. Specifically, the wall of the spindle channel 48 is distanced from the spindle 26 by a distance about equal to the diameter of the suspension cord 18. Moreover, the upper mount 40 is formed with an elongated, generally parallelepiped-shaped snap element 50, while the lower mount 42 is formed with a snap aperture 52 defining a snap edge 54. In accordance with the present invention, the snap element 50 is snappingly received in the snap aperture 52 against the edge 54.

With particular regard to the lower mount 42, as shown in FIGS. 2 and 3 the lower mount 42 includes a floor 56 that is bounded in the rear by an upwardly oriented rear wall 58. Additionally, the floor 56 is bounded on its sides by right and left side walls 60, 62. As shown, the right side wall 60 defines an insert bearing notch 64, and a guide wall portion 66 of the right side wall 60 extends between the bearing notch 64 and a front wall 68. As shown in FIG. 2, the front flange 46 is formed on the front wall 68 along the upper edge thereof.

As best shown in FIG. 2, an opening 70 is formed in the floor 56. In accordance with the present invention, the opening 70 is shaped and sized substantially like the opening 22 of the head rail 12, and is juxtaposed therewith. A finger 72 is formed on the floor 56 next to the opening 70, and the finger 72 extends upwardly from the floor 56 toward the spindle 26, adjacent the pulley 32. Also, the finger 72 is elongated and is parallel to the long axis of the opening 70, as shown. A rear end 73 of the finger 72 is bevelled.

Referring briefly to FIG. 3, the height of the finger 72 relative the floor 56 is established such that the finger 72 is closely spaced from the spindle 26, but does not touch the spindle 26. More particularly, the finger 72 is spaced a distance "D" from the spindle 26, with the distance "D" being less than the radius of the suspension cord 18, for reasons to be shortly disclosed. In the preferred embodiment, the distance "D" is equal to about five thousandths of an inch (0.005"). It can be appreciated in reference to FIG. 3 that the finger 72, together with the floor 56 of the lower mount 42, establishes an L-shaped guide member.

Figure 2A:
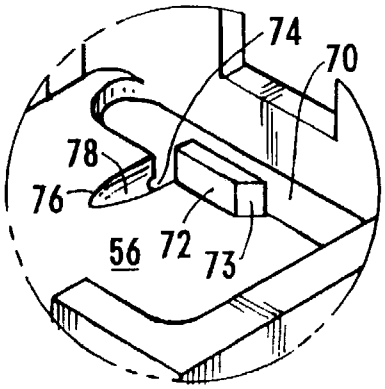
FIG. 2A is a detail of the cord notch and bearing groove shown in FIG. 2.

Referring back to FIGS. 2 and 2A, a semi-circularly shaped cord notch 74 is formed in the floor 56 of the lower mount 42, with the notch 74 communicating with the opening 70 and extending laterally away therefrom. Further, a fingernail-shaped bearing groove 76 extends laterally away from the cord notch 74 opposite the opening 70 as shown. As can be appreciated in reference to FIG. 2, the bottom surface 78 of the bearing groove 76 gradually rises from the cord notch 74 to meet the planar surface of the floor 56 of the lower mount 42.

With the above disclosure in mind, it may now be appreciated that the suspension cord 18 extends through the opening 22 of the head rail 12 and through the cord notch 74 of the lower mount 42. It may be further appreciated that the suspension cord 18 extends onto the spindle 26 between the pulley 32 and the finger 72, and that the suspension cord 18 establishes a plurality of coils **18*a* (FIG. 3) on the winding surface 28 at least when the slats 16 are not in a fully lowered configuration. As shown in FIG. 3, the coils 18*a* are disposed on the winding surface 28 on the side of the finger 72 opposite the pulley 32, with the finger 72 contacting a first coil 80**.

Stated differently, the finger 72 is oriented such that the finger 72 contacts the first coil 80. In accordance with the present invention, when the spindle 26 is rotated, the cooperation between the finger 72 and the suspension cord 18 pushes the coils **18*a* away from the finger 72**, such that successive coils are established on the winding surface of the spindle without overlapping.

I have found that the combination of structure described above, including the elongated finger 72 with bevelled rear end 73, semi-circular cord notch 74, and bearing groove 76, facilitates smoothly winding the suspension cord 18 through the notch 74 and onto the winding surface 28 of the spindle 26. In other words, the present combination of structure facilitates continuous smooth guiding and winding of the suspension cord 18 as the coils **18*a* are established on the winding surface 28 of the spindle 26**, thus further minimizing large frictional losses.

To couple the spindle 26 to the tilt rod 24, a hollow adaptor 82 is advanced into the spindle 26 in an interference fit therewith, as shown in FIG. 3A, or the hollow adaptor 82 is formed integrally with the spindle 26 during molding, as shown in FIG. 3. To couple the spindle 26 to the tilt rod 24, a hollow adapter 82 is advanced into or formed integrally with the spindle 26 near an end thereof. In accordance With the present invention, the adapter 82 is formed with a cylindrical outer surface. In contrast, the adapter 82 is formed with a central passageway 84 that is configured for closely engaging the tilt rod 24, e.g., the central passageway 84 defines a hexagonal cross-section when it is desired to couple the spindle 26 with a tilt rod 24 that has a hexagonal cross-section. Consequently, the adapter 82 is advanced over the tilt rod 24 to thereby couple tilt rod 24 to the spindle 26.

Referring back to FIG. 1, if desired the suspension cord 18 can be adjustably affixed to the tilt rod 24 by a clip 86. As shown in FIG. 2, the clip 86 is formed with a rod groove 88 that is configured for closely engaging the tilt rod 24, e.g., the rod groove 88 has a hexagonal transverse cross-section for engaging the particular tilt rod 24 shown. Also, the clip 86 is formed with a cylindrical cord groove 90 which is oriented parallel to the rod groove 88. It can be appreciated in reference to FIG. 2 that the cord groove 90 closely receives the suspension cord 18 to thereby hold the suspension cord 18 stationary relative to the tilt rod 24. A bead 92 can be attached to the suspension cord 18 to prevent the suspension cord 18 from being pulled out of the cord groove 90.

It can be further appreciated that the clip 86 can be slid on the tilt rod 24 as appropriate to adjustably affix the cord 18 to the tilt rod 24 at a desired location on the tilt rod 24. As recognized by the present invention, by adjustably affixing the suspension cord 18 to the tilt rod 24 as disclosed, the present invention can easily be adapted for use on a wide variety of window coverings. In contrast, devices such as the one disclosed in the above-mentioned Somfy patent, in which the end of the suspension cord is affixed to the winding drum instead of the tilt rod, cannot easily be adjusted to affix of the end suspension cord at a location that is optimal for the particular window covering.

While the particular SUSPENSION CORD WINDING DEVICE FOR WINDOW COVERING as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A window covering, comprising:

at least one suspension cord;

a plurality of slats engaged with the suspension cord;

a horizontally-oriented head rail formed with an opening through which the suspension cord extends;

a tilt rod disposed in the head rail;

a hollow spindle surroundingly engaged with the tilt rod and rotatable therewith, the spindle including a winding surface defining a first end, the suspension cord establishing a plurality of coils on the winding surface at least when the slats are not in a fully lowered configuration; and a guide finger fixedly disposed in the head rail adjacent the opening and extending therefrom toward the spindle with the suspension cord extending through the opening between the finger and the first end, the finger being oriented such that the finger contacts at least one coil, thereby pushing coils of the suspension cord formed on the winding surface away from the finger such that successive coils are established on the winding surface of the spindle without overlapping.

2. The window covering of claim 1, further comprising:

a tilt cord engaged with the slats for tilting the slats; and a pulley on the first end of the spindle, the pulley establishing an abutment surface, the pulley defining a tilt cord groove for receiving the tilt cord.

3. The window covering of claim 2, wherein the tilt cord groove is characterized by a rectangular cross-section.

4. The window covering of claim 1, further comprising a lower mount engaged with the head rail, the finger being formed on the lower mount.

5. The window covering of claim 4, further comprising an upper mount engaged with the lower mount, the spindle being disposed between the mounts, the upper mount being formed with a curved channel closely spaced from the spindle.

6. The window covering of claim 5, wherein the tilt rod defines a transverse cross-section, and the window covering further comprises a hollow adapter having a central passageway configured for closely engaging the tilt rod, the adapter being engaged with the spindle to thereby couple the tilt rod to the spindle.

7. The window covering of claim 1, further comprising a clip formed with a rod groove configured for closely engaging the tilt rod, the clip also being formed with a cord groove oriented parallel to the rod groove for closely receiving the suspension cord to thereby hold the suspension cord stationary relative to the tilt rod.

* * * * *